US005213644A

United States Patent [19]

Phillips et al.

[11] Patent Number: 5,213,644

[45] Date of Patent: May 25, 1993

[54] METHOD OF AND APPARATUS FOR PRODUCING MOISTURE BLOCK STRANDED CONDUCTOR

[75] Inventors: Donald R. Phillips, Delta, Ala.; Hai T. Lam, Chamblee, Ga.; Clinton E. Watkins, Villa Rica, Ga.; Steven R. Campbell, Carrollton, Ga.

[73] Assignee: Southwire Company, Carrollton, Ga.

[21] Appl. No.: 672,455

[22] Filed: Mar. 20, 1991

[51] Int. Cl.[5] ..... H01B 13/32

[52] U.S. Cl. ..... 156/51; 118/420; 174/23 C; 427/118; 427/434.7

[58] Field of Search ..... 156/51; 264/174; 57/7, 57/296, 6, 295, 297; 174/23 R, 23 C, 102 SC; 118/420; 427/118, 434.7; 29/461, 527.2

[56] References Cited

U.S. PATENT DOCUMENTS

| | | | |
|---|---|---|---|
| 2,427,507 | 9/1947 | Powell, III et al. | 156/55 |
| 2,842,837 | 7/1958 | Huet et al. | 29/527.2 X |
| 3,259,675 | 7/1966 | Bowers | 264/103 |
| 3,395,530 | 8/1968 | Campbell | 57/7 X |
| 3,503,120 | 3/1970 | Pierce | 29/527.2 |
| 3,741,153 | 6/1973 | Sears et al. | 118/420 X |
| 3,889,455 | 6/1975 | Portinari et al. | 57/7 |
| 4,017,579 | 4/1977 | Roe et al. | 264/174 |
| 4,129,466 | 12/1978 | Portinari et al. | 156/48 |
| 4,473,995 | 10/1984 | Gentry | 57/9 |
| 4,574,571 | 3/1986 | Thompson | 57/6 X |
| 4,599,853 | 7/1986 | Varga-Papp | 57/9 |
| 4,606,183 | 8/1986 | Riggs | 57/7 X |
| 4,710,594 | 12/1987 | Walling et al. | 174/120 S R |
| 4,717,604 | 1/1988 | Justus | 427/434.7 |
| 4,791,240 | 12/1988 | Marin et al. | 174/23 C |
| 4,874,442 | 10/1989 | Watkins et al. | 156/48 |
| 5,095,175 | 3/1992 | Yoshida et al. | 174/23 R |

*Primary Examiner*—David A. Simmons
*Assistant Examiner*—Mark A. Osele
*Attorney, Agent, or Firm*—James W. Wallis, Jr.; Stanley L. Tate; George C. Myers, Jr.

[57] ABSTRACT

A method of and an apparatus for applying a moisture block compound to a stranded electrical conductor using a double twist buncher apparatus are disclosed. An oil, such as drawing oil, is applied to the outer layer of wires to prevent "rolling" of the moisture block compound to the exterior of the stranded conductor. An improved applicator is also disclosed for applying the moisture block compound to the core of the stranded conductor in a coating having a precisely controlled thickness.

12 Claims, 2 Drawing Sheets

METHOD OF AND APPARATUS FOR PRODUCING MOISTURE BLOCK STRANDED CONDUCTOR

FIELD OF THE INVENTION

The present invention relates to a method of and an apparatus for producing a moisture block stranded electrical conductor on a double twist buncher. More particularly, the present invention relates to an improved method of and apparatus for applying a moisture block compound to the interstices between the core wire and the outer layer(s) of wire that are twisted over the core wire in a double twist buncher apparatus.

DESCRIPTION OF THE PRIOR ART

Stranded electrical conductors fabricated with a plurality of round wires made of an electrically conductive metal, such as copper or aluminum, are well known in the art, as are methods and apparatus for making such stranded conductors. Typically, stranded conductors are fabricated by stranding or bunching together a plurality of round wires in concentric layers about a core wire. As used herein, the term "core wire" includes a single core wire as well as a stranded conductor used as a core wire for a second or subsequent layer of wires.

Generally speaking, there are three conventional types of apparatus for making stranded electrical conductors having a plurality of round wires which are twisted about the longitudinal conductor axis. One known apparatus known as a rigid frame strander employs a rotating pay-out system. In a rigid frame strander, a plurality of spools of wire are mounted on a rotatable laying head through which a core wire passes. As the laying head is rotated, the wires from the plurality of spools are helically wrapped or twisted about the advancing core wire and passed through a closing die to form a stranded conductor which is collected on a take-up reel.

A second type of apparatus employs a rotating take-up reel in which the take-up reel is rotated about two axes, namely, the reel axis for take-up purposes and the conductor axis to provide a twist to the conductor. In this second type of apparatus, a plurality of wires are advanced in substantially side-by-side relation from a plurality of spools or stem packs mounted on a stationary platform. The wires are guided to a stationary lay plate through the axis of which one of the wires passes as a core wire and the remaining wires are concentrically spaced about the core wire. The wires are passed from the lay plate to a closing die and thence to take-up reel which twists the stranded conductor.

The third known type of apparatus for making stranded cable is a buncher, e.g., a double twist buncher, in which the wires are advanced from stationary spools in side-by-side relation through a stationary twist plate and to a closing die. In the buncher, however, neither the pay-out system nor the take-up system rotates but a twist is applied to the wires of the stranded conductor by a rotating bow mechanism located between the closing die and the take-up reel. Advantageously, the double-twist buncher is a more efficient and economical apparatus than either the rigid frame strander with a rotating pay-out system or the apparatus with a rotating take-up reel because the double twist buncher provides two twists in the stranded conductor for each revolution of the rotating bow. Thus, for a given speed of rotation, production rate of a buncher is almost twice the production rate of the machines with a rotating pay-out or take-up system. Moreover, the double twist buncher is a more compact system because the pay-out spools and the take-up reel, need not be mounted for rotation as they must in the other types of stranding apparatus.

When round wires of the same diameter are used to form a stranded conductor, e.g., a seven stranded conductor, six wires are normally stranded concentrically about a single core wire. For stranded conductors with a greater number of strands, successive concentric layers typically include six strands more than the number of strands in the preceding layer. Thus, a stranded conductor with a core wire and two concentric wire layers typically comprises nineteen (19) wires, i.e., the core wire, six wires in the first layer and twelve wires in the second layer. A stranded conductor with a core wire and three concentric wire layers comprises thirty-seven (37) wires, i.e, the core wire, six wires in the first layer, twelve in the second layer and eighteen in the third layer. Of course, stranded conductors may be formed with a greater or lesser number of wires in each successive layer, the important parameter being the total or cross-sectional area of the wires.

One disadvantage of stranded conductors, particularly those intended for underground use, is the tendency for water or moisture to flow or seep longitudinally through the stranded cable in the interstices between the core wire and the surrounding wires in the first concentric layer, or between the wires of the first and second concentric layers and so on. Heretofore, numerous attempts have been made to prevent the flow of water or moisture longitudinally through the stranded conductor using various methods, apparatus and moisture block compounds. One such method is disclosed in U.S. Pat. No. 4,874,442 assigned to the assignee of the present invention. In that method, a plurality of wires including a core wire are passed through a cone die into which a moisture block compound is fed by a pump via a connecting pipe. A first layer of outer wires is loosely stranded by a rotating pay-out system over a core wire and coated with a predetermined volume of moisture block compound. This loosely stranded conductor is then passed through a closing block with another plurality of wires mounted on another rotating pay-out system to form a second layer of outer wires. The conductor exiting the closing block is a finished stranded conductor which has been treated with a volume of moisture block compound sufficient to fill all the interstitial spaces in the stranded conductor.

Another method of producing a moisture block stranded conductor is disclosed in U.S. Pat. No. 2,427,507 in which a blocking compound is applied to a center strand which passes through an opening in the center of a rotating pay-out head. The pay-out head twists a plurality of wires about the core such that the sealing compound fills the interstices between the core wire and the twisted wires.

U.S. Pat. Nos. 3,889,455 and 4,129,466 disclose other methods of and apparatus for applying a moisture block to a stranded conductor by passing the wires through a tank or chamber containing the blocking material. These patents disclose the use of the moisture block methods and apparatus with stranders using either a rotating pay-out system or a rotating take-up system.

When applying a moisture blocking compound to a stranded conductor with one or more concentric layers of wires, the amount of moisture blocking compound must be carefully controlled to prevent excess moisture blocking compound from seeping through the outer layer of wires and onto the outer surfaces of the stranded conductor. By the proper sizing of the die through which the moisture block-coated core wire or stranded conductor is passed and by controlling the application pressure of the compound, the amount of applied compound may be precisely regulated. One problem that can occur, especially in the case of stranded conductor made on a double twist buncher, results from the inherent additional twist induced in the individual wires as they enter the buncher apparatus. Such additional twist causes each wire to rotate approximately one-quarter turn at the final twisting point of the machine thereby causing the moisture block compound to be carried or "rolled" to the outer interstices of the stranded conductor. Such rolling action depletes the controlled amount of moisture block compound in the interstices between the core wire and the layer of wires surrounding the core wire and undesirably results in the outer surfaces of the wire layer becoming coated with moisture block compound.

SUMMARY OF THE INVENTION

In view of the foregoing limitations and disadvantages of the prior art methods and apparatus for moisture blocking stranded conductors made with round wire, especially those made on a buncher-type apparatus, it should be apparent that there still exists a need in the art for a method of producing a moisture blocked stranded cable in which the moisture block compound is precisely controlled and confined to the inner interstices between the core wire and the surrounding layer of wires. It is, therefore, a primary object of this invention to fulfill that need by providing a method of and an improved buncher apparatus for applying a moisture block compound to a stranded conductor made from a plurality of round wires wherein a thin coating of oil is applied to the wires of the outer layers prior to contacting the core wires to prevent them from "rolling" the moisture block compound on the core wire from the inner interstices to the outer surfaces of the stranded conductor.

Advantageously, in a double twist buncher apparatus the oil is applied to each outer wire as it passes through its respective eyelet in the inlet block of the buncher apparatus. In the case of stranded conductors having more than one concentric layer of wires, oil is applied only to the outermost concentric layer and not to the core (which comprises a center wire and one or more concentric layers of wires). The moisture block compound is applied to a cleaned or degreased core wire so as to ensure adhesion of the blocking compound to the core wire. The compound-coated core wire is then passed through a die sized to achieve a precisely controlled amount of blocking compound surrounding the core. Since the layer of outer wires has an oil coating, the moisture blocking compound does not adhere to the outer wires and is not "rolled" to the outer surfaces of the stranded conductor. As the outer layer of wires is twisted over the core wire, there is sufficient mechanical pressure between the core wire and the outer layer of wires to effect a satisfactory moisture block seal, i.e., in the manner of a gasket seal. Thus, the lack of adhesion between the moisture block compound and the outer layer of wires does not adversely affect the moisture blocking of the stranded conductor.

One oil that has been successfully used in the inventive method with aluminum wires is Cindol 4683 wire drawing oil made by E. F. Houghton Co. of Valley Forge, Pa., however, those skilled in the art will appreciate that there are many equivalent oils that may be used.

The invention also comprises an improved applicator head and die holder for application of the moisture block compound to the core wire (or core wires in the case of a seven strand core wire). The applicator head comprises a small cylindrical chamber into which a moisture block compound is introduced from an extruder at a pressure slightly greater than atmospheric pressure. A split die with a central bore is mounted in one end of the chamber and is held in place by a U-shaped threaded die cap. The central bore of the split die has a tightly toleranced diameter so as to closely control the thickness of moisture block compound on the core wire passing through it. The back or upstream end of the chamber is provided with a removable plug with a bore through which the core wire passes into the chamber. In the case of a core made up of seven strands, for example, the plug functions as a closing die for the outer layer of six strands.

Relief holes or grooves are provided around the periphery of the removable plug so that the machine operator can control the flow of moisture block compound to prevent underfilling of the stranded conductor as well as to prevent excessive overfilling that might cause an excess of moisture block compound to extrude through the split die and around the core wire.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
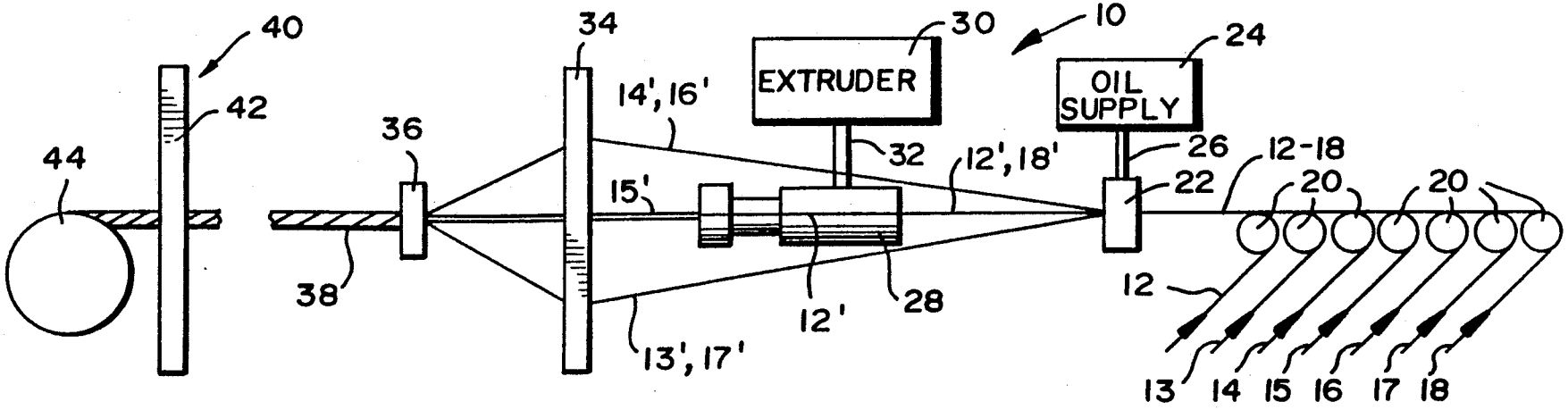
FIG. 1 is a schematic side elevation view of a double twist buncher incorporating the moisture block apparatus of the invention for making a seven strand moisture blocked conductor.
Figure 2:
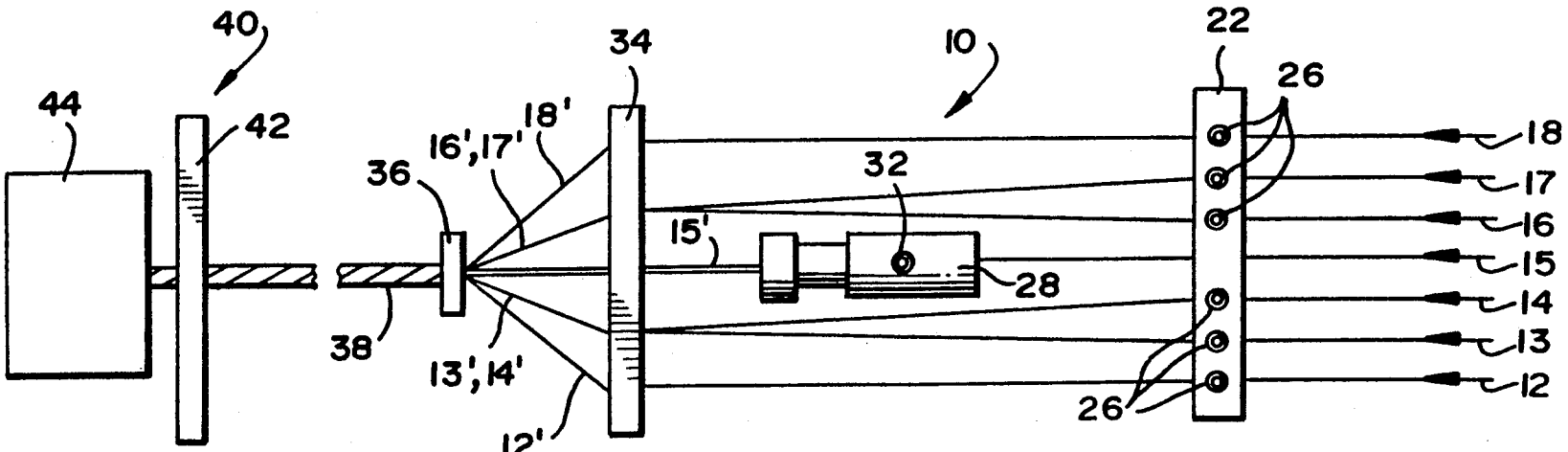
FIG. 2 is a schematic top plan view of the buncher apparatus of FIG. 1.

Referring now in detail to the drawings, there is schematically illustrated in FIGS. 1 and 2 a buncher apparatus designated generally by reference numeral 10 which is operated in accordance with the method of the invention. The apparatus 10 may be a conventional buncher known as a double twist buncher made by Ceeco of Concord, Ontario, Canada, but modified to incorporate the present invention. As shown in FIGS. 1 and 2 a plurality of round wires 12, 13, 14, 15, 16, 17, 18 comprising seven equal diameter wires are withdrawn from a respective spool or reel (not shown) and pass over a respective pulley or sheave 20 from which they are guided in a generally horizontal direction to an inlet block 22 of the buncher apparatus 10. The wires 12–18 may be formed of any conductive metal, especially aluminum or copper or alloys thereof. Inlet block 22 is provided with a plurality of eyelets (not shown) through which a respective one of the wires 12–18 is guided into a common horizontal plane. The wire 15 is the core wire and the wires 12–14 and 16–18 will be twisted by the buncher apparatus 10 about the core wire 15 to form an outer concentric layer of wires surrounding core wire 15 as shown in cross-section in FIG. 6.

An oil supply reservoir 24 is connected via pipes 26 to the inlet block 2 which is provided with internal passages (not shown) intersecting the eyelets through which the wires 12–14 and 16–18 travel. No oil is supplied to the eyelet through which the core wire 15 passes (FIG. 2). The supply of oil is sufficient to lightly coat the surfaces of each wire 12–14, 16–18 for a purpose to be hereinafter described.

Downstream of the inlet block 22, the core wire 15 passes into an applicator head 28 to which a moisture block compound is supplied by an extruder 30 via a heated pipe 32. Head 28 applies a controlled amount of moisture block compound to the outer circumferential surface of core wire 15 as a coating having a uniform and precisely controlled thickness. The coated core wire 15′ exits the head 28 and passes through a central opening (not shown) in stationary twist plate 34.

The oiled wires 12′–14′ and 16′–18′ travel outside of and past the applicator head 28 where they are guided through the twist plate 34 by rollers (not shown) mounted in the twist plate 34 at 60° spacings about the twist plate axis along which coated core wire 15′ travels. Downstream of the twist plate 34 there is arranged a closing die 36 where the oiled wires 12′–14′ and 16′–18′ are converged onto the outer surface of moisture block-coated core wire 15′. The oiled wires are twisted over the coated core wire 15′ to form a moisture blocked stranded conductor 38 (FIG. 6) by a conventional take-up system 40 comprising a rotating bow 42 which rotates about the axis of conductor 38 to twist the same and a take-up reel 44 which rotates only about a horizontal axis transverse to the longitudinal axis of the buncher apparatus 10 to take-up the stranded conductor.

Figure 6:
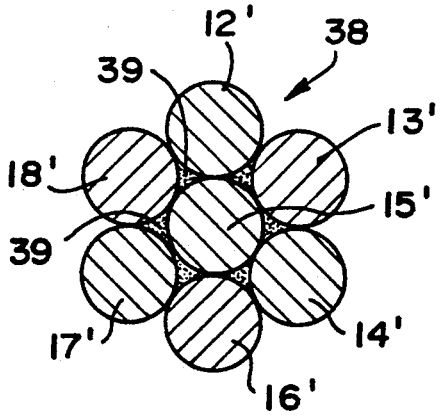
FIG. 6 is a cross-section of a moisture blocked seven strand conductor.

When the oiled wires 12′–14′ and 16′–18′ reach the first twisting point at or adjacent the closing die 36, each wire is wound around the coated core wire 15′ to form a stranded conductor. Subsequently, a second twist is imparted to the entire stranded conductor which causes each wire to rotate about its own axis approximately a one-quarter turn. This wire rotation is inherent in the double twist buncher apparatus. The oil on the wires 12′–14′ and 16′–18′ prevent the moisture block compound on coated wire 15′ from adhering to the surfaces of those wires and thus prevents "rolling" of the compound to the outside of the stranded conductor 38. Thus, as shown in FIG. 6, the inner interstices between the core wire and the outer concentric layer of wires are completely filled with moisture block compound 39 and no compound is "rolled" or otherwise caused to flow to the outer surfaces of the stranded conductor.

Figure 3:
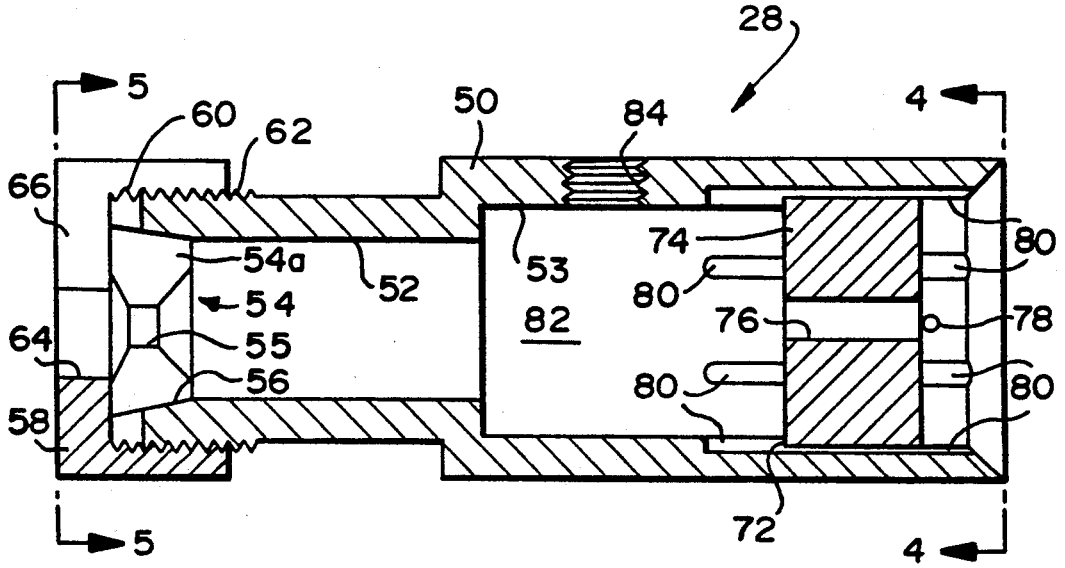
FIG. 3 is a side elevation view in cross-section of the applicator head of the present invention.
Figure 5:
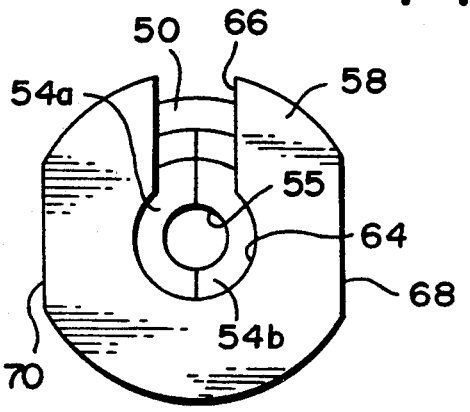
FIG. 5 is an end view of the die cap and applicator taken along line 5—5 of FIG. 3.
Figure 4:
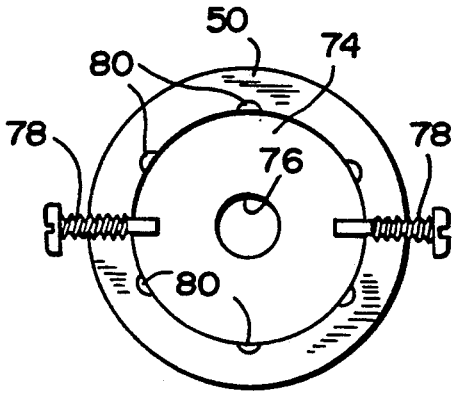
FIG. 4 is an end view of the applicator head of FIG. 3 taken along line 4—4 of FIG. 3.

Referring now to FIGS. 3–5 there is shown in cross-section one embodiment of the applicator head 28 for applying the moisture block compound to the core wire of a stranded conductor having seven wires. Head 28 comprises a cylindrical chamber body 50 with a stepped bore 52, 53 extending therethrough. A tapered split die 54 is inserted in a tapered portion 56 of the downstream end of the bore 52 and is urged into tight sealing relation with the tapered portion 56 by a die cap 58. Die cap 58 has an internal thread 60 which is threadably engaged with the external thread 62 on the downstream end of the body 50. Die 54 has a central bore 55 which is closely toleranced to precisely control the diameter and amount of moisture block compound applied to the core wire.

As best seen in FIG. 5, the die cap 58 has a generally U-shaped form with an axial bore 64 intersected by a wide radial slot 66 so that the die cap can be assembled to and removed from the thread 60 on the body 50 when a core wire extends axially through the body. The die cap 58 is also provided with a pair of parallel flat surfaces 68, 70 to facilitate threading the die cap onto and off of the threaded end of the body with a wrench or other tool. The die 54 is preferably formed as a split die, i.e., made in two identical parts 54*a*, 54*b* so that the die 54 can be removed and replaced when a core wire extends along the axis of the body 50. Replacement of a die 54 may be necessary when the core wire is strung through the applicator, for example, when it is necessary to change the diameter of the bore 55 to adjust the thickness of the moisture block compound on the core wire.

The bore 53 in the upstream end of the body 50 has an annular shoulder 72 against which a closing plug 74 abuts. Closing plug 74 has a central bore 76 through which the core wire passes and is held in position by locking screws 78 threaded through the wall of body 50. If desired, the closing plug 74 may also be fabricated in two identical pieces similar to the split die 54. A plurality of longitudinally extending grooves 80 are machined in the wall of body 50 defined by bore 53. Grooves 80 extend from the open upstream end of the body 50 past the plug 74 and shoulder 72 and terminate in the chamber 82 defined by the bores 52, 53 and the confronting end surfaces of the die 54 and the plug 74. It would also be possible to provide grooves or channels in the outer periphery of the closing plug 74.

Moisture block compound is introduced into the chamber 82 from extruder 30 via heated pipe 32 (FIG. 1) which is threadably connected to a threaded bore 84 in the wall of body 50. In operation, a core wire travels through the bore 76 in plug 74, the chamber 82 and the central bore 55 in split die 54 from right to left as viewed in FIG. 3. Moisture block compound is forced through bore 84 under a pressure slightly greater than atmospheric into the chamber 82 to fill it. As the core wire passes through the chamber 82, moisture block compound adheres to the cleaned and degreased surface of the core wire and the bore 55 in die 54 precisely controls the thickness of the compound coating on the core wire as it passes through the die 54.

The moisture block compound in chamber 82 is also forced through grooves 80 and out the upstream ends of the grooves. By visually observing the amount and rate of compound flowing from the grooves, the machine operator can regulate the flow and pressure of the extruder to prevent overfill and underfill conditions. If compound is observed flowing out of the grooves 80, an overfill or overpressure condition exists which could cause an excess amount of compound to flow out of the split die around the core wire. On the other hand, if compound is observed flowing from the grooves 80 inwardly toward the chamber 82, an underfill or underpressure condition exists which could result in voids in the moisture block coating on the core wire and an insufficient amount of compound on the core wire to fill all the inner interstices. The possibility of voids in the moisture block coating is not only the result of an underfill or underpressure condition in the applicator. Voids in the coating can also result from the natural tunneling effect of a non-rotating wire passing through the moisture block compound at a relatively high rate of speed. It is, therefore, desirable to maintain a slight overfill condition of the applicator to substantially eliminate the possibility of voids in the moisture block coating.

It is also possible to manufacture moisture blocked stranded electrical conductors with a greater number of wires than the seven wire conductor described above in connection with FIGS. 1, 2 and 6. For example, a stranded conductor with nineteen wires as shown in cross-section in FIG. 7 designated with reference numeral 100 can also be made in a double twist buncher of the type shown in FIGS. 1 and 2. In such case, the core comprises the seven wires 102 corresponding to the seven wires shown in FIG. 6 and the outer layer of wires comprises the twelve wires 104 surrounding the core 102. Moisture block compound 106 fills all the inner interstices between the wires 102 and between the wire 102 and the wires 104. The seven wires 102 pass through inlet block eyelets which are not connected to an oil supply. The twelve wires 104 pass through oiled eyelets in the inlet block. Wires 102 are guided into the upstream end of the applicator head by a conical closing die which replaces the plug 74. Die 54 is replaced by a split die having a bore with a diameter greater than the diameter of bore 55. The seven strand core of wires 102 exits the die coated with moisture blocking compound having a precisely controlled diameter. The oiled wires 104 pass through a twist plate similar to plate 34 and are converged onto the moisture block-coated core in a closing die in the same manner as shown in FIGS. 1 and 2.

Figure 7:
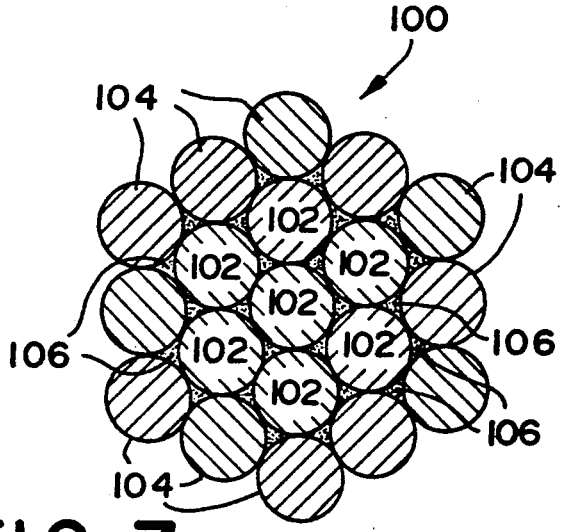
FIG. 7 is a cross-section of a moisture blocked nineteen strand conductor.

The invention also contemplates constructions of stranded electrical conductors other than those shown in FIGS. 6 and 7. For example, stranded conductors having a compacted core formed six or seven shaped wires (e.g., generally trapezoidal in cross-section) concentrically disposed about a round core wire and an outer layer of round core wires arranged about the compacted core may be made according to the method of the invention using the apparatus of the invention. Likewise, combination stranded conductors having round wires of differing cross-sections, such as a Unilay construction made according to ASTM B786-88 are also contemplated by the invention. It is also possible to use the double twist buncher to fabricate a fully compacted stranded conductor with moisture blocking compound in all inner interstices of the conductor. Such conductors are made of a plurality of shaped wires having a trapezoidal cross-section arranged about a round core wire. In the case of a fully compacted conductor, it is not necessary to oil the outermost layer of shaped wires since the shaped wires are prevented by their shape from rotating at the final twisting point of the buncher.

It is also within the scope of the present invention to supply oil to the outermost layer of round wires at a point downstream of the inlet block. Those skilled in the art will appreciate that so long as the outer layer of wires are oiled prior to entry into the closing die 36 of the buncher apparatus of FIGS. 1 and 2 "rolling" of the moisture block compound can be prevented and that objective of the invention can be accomplished.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A wire stranding apparatus including a double twist buncher apparatus for fabricating a moisture blocked stranded conductor having a core and a first plurality of wires surrounding the core, said conductor having inner interstices between the core and said first plurality of wires, comprising:

means for delivering the core and the plurality of wires to the double twist buncher;

means for applying a coating of moisture block compound to the core;

means for twisting said first plurality of wires about the coated core so as to fill the inner interstices with moisture block compound and form a moisture blocked stranded conductor;

means arranged upstream of said twisting means for applying oil only to said first plurality of wires surrounding the core; and means for taking-up the stranded conductor.

2. The apparatus of claim 1, wherein said oil applying means comprises an inlet block having eyelets through which the core and said plurality of wires pass and a supply of oil connected to the eyelets through which said first plurality of wires pass.

3. The apparatus of claim 1, wherein said core comprises only one round wire and said first plurality of wires comprises round wires.

4. The apparatus of claim 1, wherein said core comprises a second plurality of wires and said first plurality of wires comprises round wires.

5. The apparatus of claim 6, wherein the apparatus is adapted for handling wires in which at least some of the wires of the core are generally trapezoidally shaped in cross-section.

6. The apparatus of claim 5, wherein the apparatus is adapted for handling wires in which said second plurality of wires are round wires and said first plurality of round wires includes wires of different diameters.

7. A wire stranding apparatus including a double twist buncher apparatus for fabricating a moisture blocked stranded conductor having a core and a first plurality of wires surrounding the core, said conductor having inner interstices between the core and said first plurality of wires, comprising:

means for delivering the core and the plurality of wires to the double twist buncher;

means for applying a coating of moisture block compound to the core;

means for twisting said first plurality of wires about the coated core so as to fill the inner interstices with moisture block compound and form a moisture blocked stranded conductor;

means arranged upstream of said twisting means for applying oil only to said first plurality of wires surrounding the core so as to prevent rolling of said moisture block compound out from the inner interstices; and means for taking-up the stranded conductor.

8. A method of fabricating a moisture blocked stranded conductor having a core and a first plurality of wires surrounding the core, said conductor having inner interstices between the core and said first plurality of wires, comprising the steps of:

delivering said core and said first plurality of wires to a buncher apparatus;

applying a coating of moisture block compound to the core;

applying oil only to said first plurality of wires;

twisting the oiled first plurality of wires about the coated core so as to fill the inner interstices between the core and the first plurality of wires with moisture block compound and form a moisture blocked stranded cable.

9. The method of claim 8, including the step of taking-up the stranded cable, said twisting step being performed upstream of the taking-up step and downstream of the step of applying moisture block compound to the core.

10. The method of claim 8, wherein said oil is a wire drawing oil.

11. The method of claim 8, wherein said oil supplying step is performed upstream of the moisture block applying step.

12. The method of claim 8, wherein said core comprises a second plurality of wires.

* * * * *